United States Patent [19]

Ciampolini et al.

[11] Patent Number: 4,736,722

[45] Date of Patent: Apr. 12, 1988

[54] SYSTEM FOR AUTOMATICALLY DEFINING THE MINIMUM SETTING OF AN ACCELERATOR-CONTROLLED VALVE FOR SUPPLYING AN INTERNAL COMBUSTION ENGINE

[75] Inventors: Franco Ciampolini, Bologna; Michele Scarnera, Monzuno, both of Italy

[73] Assignee: Weber S.p.A., Turin, Italy

[21] Appl. No.: 881,185

[22] Filed: Jul. 2, 1986

[30] Foreign Application Priority Data

Jul. 12, 1985 [IT] Italy ..... 67641 A/85

[51] Int. Cl.[4] ..... F02D 41/16

[52] U.S. Cl. ..... 123/339; 123/361

[58] Field of Search ..... 123/339, 361, 399

[56] References Cited

U.S. PATENT DOCUMENTS

| | | | |
|---|---|---|---|
| 4,432,318 | 2/1984 | Kobashi et al. | 123/361 X |
| 4,475,503 | 10/1984 | Nakamura et al. | 128/361 X |
| 4,523,564 | 6/1985 | Sturdy | 123/361 |
| 4,532,901 | 8/1985 | Sturdy | 123/361 X |

*Primary Examiner*—William A. Cuchlinski, Jr.

*Attorney, Agent, or Firm*—Gifford, Groh, VanOphem, Sheridan, Sprinkle and Dolgorukov

[57] ABSTRACT

A system for automatically defining the minimum setting of a valve controlled by an accelerator for supplying air to an internal combustion engine, which system comprises means for repeatedly detecting the setting of the valve in relation to a given minimum setting value; which means define a new given minimum setting value, should the setting of the valve remain steadily, in excess of given time limits, within setting limits respectively over and below the aforementioned given minimum setting value.

10 Claims, 2 Drawing Sheets

SYSTEM FOR AUTOMATICALLY DEFINING THE MINIMUM SETTING OF AN ACCELERATOR-CONTROLLED VALVE FOR SUPPLYING AN INTERNAL COMBUSTION ENGINE

BACKGROUND OF THE INVENTION

The present invention relates to a system for automatically defining the minimum (i.e. closed) setting of a valve controlled by an accelerator for regulating air supply to an internal combustion engine, in particular, a throttle valve located at the inlet of an induction manifold on an electronic injection system.

Electronic injection systems on internal combustion engines are known to present an electronic control system which, depending on signals received from various sensors (mainly engine speed/stroke and air intake pressure/temperature sensors) determines, for example, the air density in the manifold and engine speed, and calculates, via interpolation on respective memorized maps, the stroke and timing for injecting fuel into the injectors, as well as the spark lead. Provision may be made for one of the said injectors on each cylinder, i.e. located downstream from the throttle valve, or for a single injector located upor downstream from the said throttle valve. For determining specific operation of the electronic control system, particularly during transient states, the said control system is supplied with signals from additional sensors, such as a throttle angle sensor, which also indicates the minimum (substantially closed) setting of the valve. The throttle angle transducer usually empolyed is a potentiometer connected mechanically to the valve spindle, the electric output signals from the potentiometer being supplied to an analogue-digital converter which supplies the throttle setting signal to the control system. Such known solutions, however, involve a number of drawbacks in terms of precise indication of the said minimum setting, particularly long-term precision, which may be affected by incorrect positioning of the potentiometer on the valve spindle, or by other sources of error due to thermal drift, mechanical wear, etc.

SUMMARY OF THE INVENTION

The aim of the present invention is to provide a system for automatically defining the minimum setting of an accelerator-controlled valve for supplying an internal combustion engine, designed to overcome the aforementioned drawbacks, i.e. a system enabling said minimum setting to be regulated automatically, eliminating the effect of potential initial setting errors, or subsequent thermal drift or mechanical wear.

Further aims and advantages of the present invention will be disclosed in the following description.

With this aim in view, according to the present invention, there is provided a system for automatically defining the minimum setting of a valve controlled by an accelerator for supplying an internal combustion engine, characterised by the fact that it comprises means for repeatedly detecting the setting of said valve in relation to a given minimum setting value, said means defining a new said given minimum setting, should said setting of said valve remain steadily, in excess of given time limits, within setting limits respectively over and below said given minimum setting value.

BRIEF DESCRIPTION OF THE DRAWINGS

One embodiment of the present invention will be described by way of a non-limiting example, with reference to the accompanying drawings, in which.

DETAILED DESCRIPTION OF THE INVENTION

Figure 1:
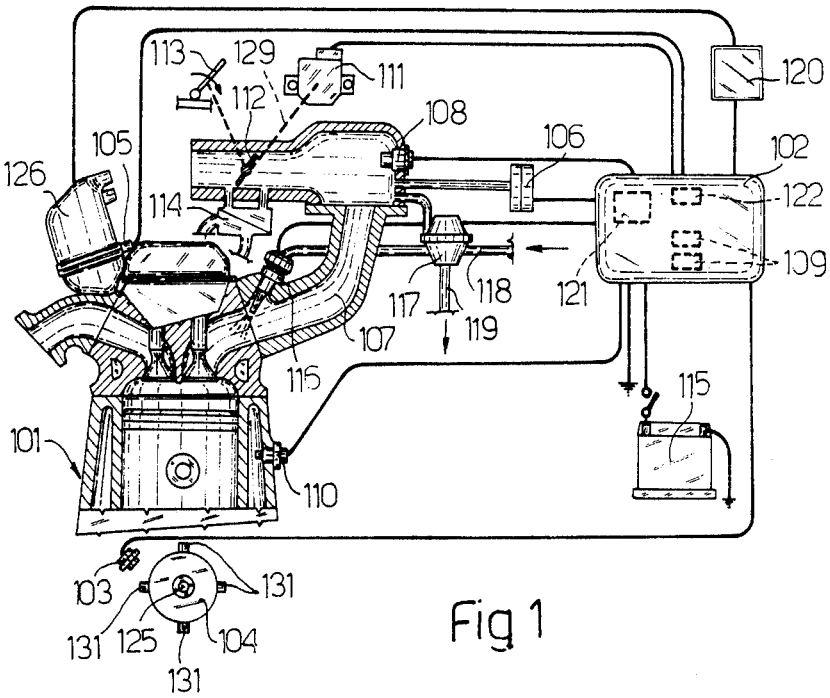
FIG. 1 shows a schematic view of an electronic injection system for an internal combustion engine with the system for automatically defining the minimum setting of a throttle valve according to the present invention.

FIG. 1 shows, schematically, an electronic injection system for an internal combustion engine 101, conveniently a four-cylinder engine, shown partially and in cross section.

The said system comprises an electronic control system 102 comprising, in substantially known manner, a microprocessor 121, and registers in which are memorized maps relative to various operating conditions of engine 101. The control system 102 also comprises memory registers 109 and an up-down counter 122 ranging from 0 to 255, and receives signals from :

- a sensor 103, for detecting the speed of engine 101, located opposite a pulley 104 fitted onto drive shaft 125 and having four teeth 131 equally spaced at 90° intervals;
- a sensor 105, for detecting the stroke of engine 101 and located in a distributor 126;
- a sensor 106, for detecting the absolute pressure inside an induction manifold 107 on engine 101;
- a sensor 108, for detecting the air temperature inside manifold 107;
- a sensor 110, for detecting the water temperature inside the cooling jacket on engine 101;
- a sensor 111 consisting of a potentiometer mechanically connected to a spindle 129 related to the angle of a throttle valve 112 located inside induction manifold 107 and controlled by the pedal of accelerator 113. Parallel to the said throttle valve 112, there is provided an additional air supply valve 114.

The electronic control system 102 is connected to an electricity supply battery 115 and grounded, and, depending on the signals from said sensors, engine speed and air density are employed for determining fuel supply according to the required mixture strength. The control system 102 therefore controls the opening time of electroinjectors 116 located inside manifold 107 next to the intake valve of each respective cylinder, for controlling fuel supply to the cylinders on engine 101, and also controls injection timing for commencing fuel supply according to the stroke (induction, compression, expansion, exhaust) of engine 101. Each electroinjector 116 is supplied with fuel via a pressure regulator 117 sensitive to the pressure inside induction manifold 107 and having a fuel inlet duct 118 from a pump (not shown) and a return duct 119 to a tank (not shown). Electronic control system 102 is also connected to a unit 120 for controlling the ignition pulses supplied to distributor 126.

The system for automatically defining the minimum setting of throttle valve 112 according to the present invention will now be described with reference to FIG. 2, with a brief preview of FIG. 3 in which POSFARF indicates the digital signal supplied by potentiometer 111 and indicating the angle of throttle valve 112. In the system according to the present invention, the said POSFARF value may only represent a preselected minimum setting value within the O and SSF value range, as described later on. FARMIN indicates the digital value assumed as a preselected minimum setting value of throttle valve 112. ISTMIN indicates an angle range in excess of the FARMIN value and within which may be located a newly-defined minimum setting of throttle valve 112, higher than the preselected minimum setting value, as described in more detail later on. The system for automatically defining the minimum setting of throttle valve 112, according to the present invention, briefly operates as follows. If, via microprocessor 121, the setting of the said throttle valve 112 (as indicated by the POSFARF signal) is found to be steady, either below the FARMIN value, as far as zero, or over the FARMIN value, within the ISTMIN range, for longer than given preset time limits, the said steady setting is taken as corresponding to a new minimum setting, which is thus redefined by progressively shifting the previously memorized setting, within the said limit values O and SSF.

Figure 2:
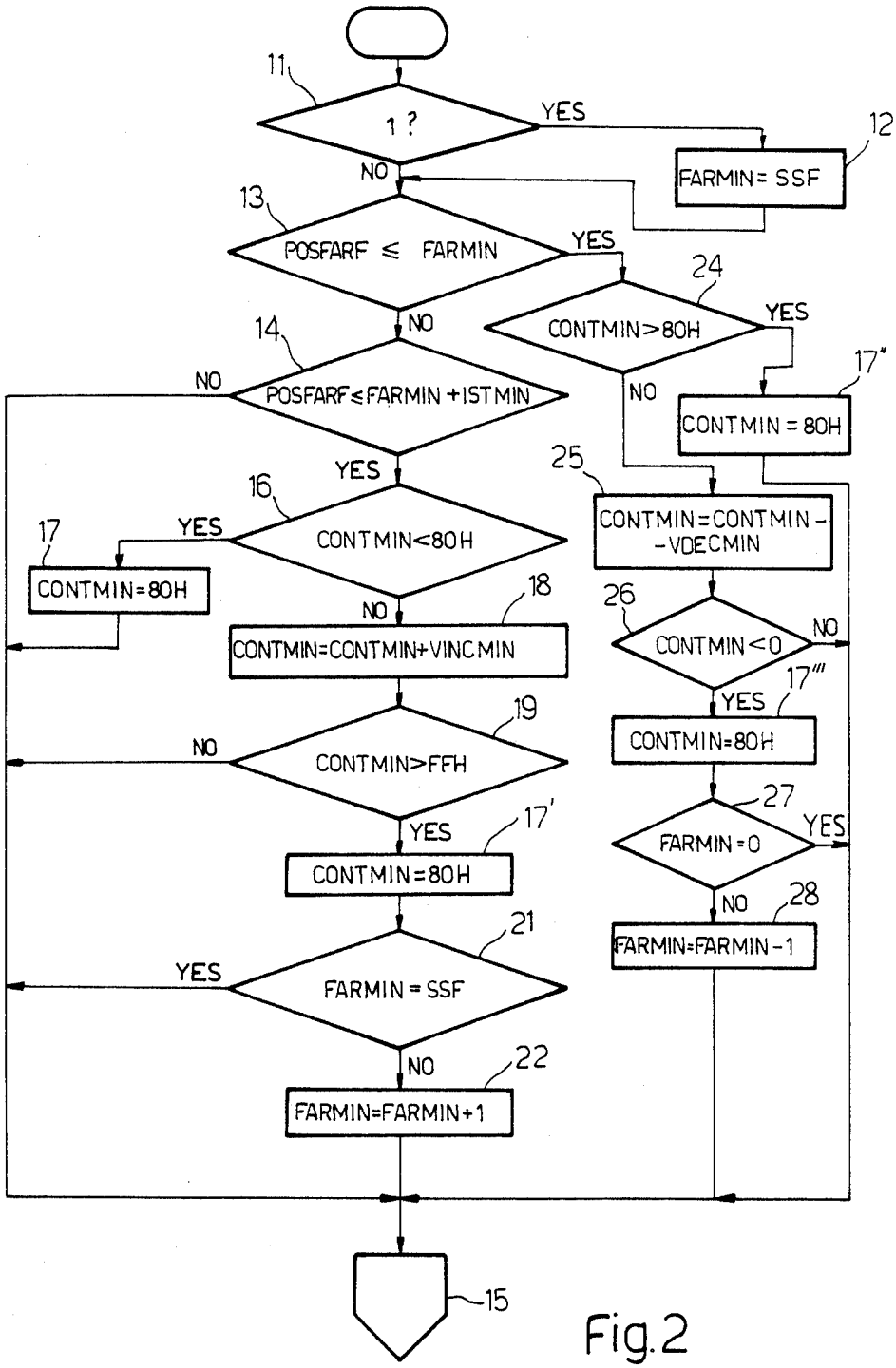
FIG. 2 shows an operating block diagram of the system for automatically defining the minimum setting of a throttle valve according to the present invention.

FIG. 2 shows the routine performed repeatedly by microprocessor 121 at each general performance of the processing routine for the electronic injection system, and which, with engine 101 idling, is repeated approximately every 30 milliseconds. Block 11 determines whether the program performance in question is the first for starting up the engine. In the event of a positive response, block 11 goes on the block 12, which enters, as an initial preselected minimum setting value for throttle valve 112, the maximum value permitted: FARMIN=SSF, after which, block 12 goes on to block 13. In the event of a negative response in block 11, i.e. in subsequent repeat performances of the program, block 11 goes directly on to block 13, which determines whether the setting of throttle valve 112 (POSFARF) is less than or equal to the preselected minimum setting value (FARMIN). In the event of a negative response, assuming, for example, a valve setting as shown by letter A in FIG. 3, block 13 goes on to block 14, which determines whether the said valve setting is less than or equal to the said preselected minimum setting value (FARMIN) plus the ISTMIN range. Assuming the valve setting is as shown by A in FIG. 3, the response from block 14 will be negative, in which case, block 14 goes directly on to an output block 15, which controls subsequent program stages by microprocessor 121 for calculating injection and ignition timing with no change in the said preselected minimum setting value (FARMIN) in that the detected setting value (A) is greater than the preselected minimum setting value.

If, on the other hand, the setting of throttle valve 112 is as shown by letter B in FIG. 3, i.e. within the ISTMIN range, block 14 issues a postive response and goes on to block 16, which determines whether the content of counter 122 is below hexadecimal 8OH, i.e. below 128, which is the count initiation value of counter 122, as described in more detail later on. A positive response indicates the existence of previous stages in which the setting of throttle valve 112 was below the preselected minimum setting value (FARMIN), in which case, block 16 goes on to block 17, which resets counter 122 to the initial 8OH value and then goes on to block 15. In the event of a negative response, however, in block 16 (steady setting within the ISTMIN range), block 16 goes on to block 18, which steps up the content of counter 122 by a quantity VICNMIN. Block 18 then goes on to block 19, which determines whether the content of counter 122 exceeds the maximum value FFH, i.e. 255. In the event of a negative response, block 19 goes on to block 15, for repeating the processing cycle in a subsequent program cycle. In the event of a positive response (maximum count on counter 122, thus indicating that setting B has been maintained over a given preset time limit), block 19 goes on to block 17' which, like block 17, resets counter 122 to 8OH and then goes on to block 21, which determines whether the memorized preselected minimum setting value (FARMIN) is equal to the maximum permitted value (SSF). In the event of a positive response, the said value is left unchanged and block 21 goes on to output block 15. In the event of a negative response, block 21 goes on to block 22 which defines a new preselected minimum setting value, by adding one count unit to the previous value: FARMIN=FARMIN +1, and then goes on to output block 15.

Figure 3:
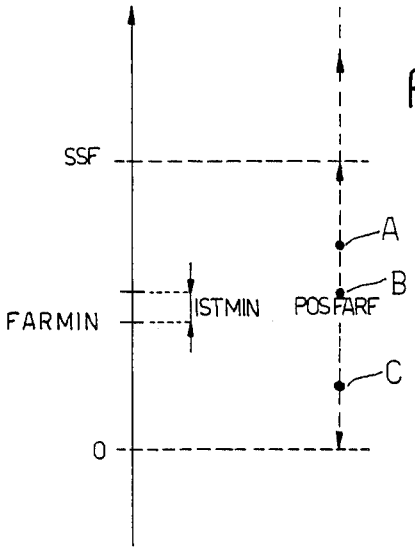
FIG. 3 shows, schematically, the behaviour of a number of signals on the system according to the present invention.

If, on the other hand, the setting of throttle valve 112 is as shown by the letter C in FIG. 3, block 13 goes on to block 24, which determines whether the content of counter 122 is over 8OH, thus indicating that, in previous processing stages, the setting of throttle valve 112 was maintained steadily within the ISTMIN range. In the event of a postive response, block 24 goes on to block 17" which, like block 17, resets counter 122 to the initial 8OH value and then goes on to block 15. In the event of a negative response in block 24 (indicating that, in previous processing stages, the setting of throttle valve 112 was maintained steadily below the FARMIN value), block 24 goes on to block 25, which subtracts, from the content of counter 122, a quantity VDECMIN conveniently greater than the VINCMIN quantity added in block 18. Block 25 then goes on to block 26, which determines whether the content of counter 122 is below zero, i.e. whether the setting of throttle valve 112 has been below the preselected minimum setting value (FARMIN) for longer than a given preset time limit depending on the VDECMIN value. In the event of a negative response, block 26 goes on to output block 15, for performing a further processing stage via control system 102. In the event of a postive response, block 26 goes on to block 17''' which, like block 17, resets counter 122 to the initial 8OH value and then goes on to block 27, which determines whether the preselected minimum setting value (FARMIN) equals zero. In the event of a positive response, the said preselected minimum setting value is left unchanged and block 27 goes on to block 15. In the event of a negative response (as in the case of setting C in FIG. 3), block 27 goes on to block 28, which defines a new preselected minimum setting value by subtracting one count unit from the previous value: FARMIN=FARMIN−1, and then goes on to output block 15.

The advantages of the system for automatically defining the minimum setting of an accelerator-controlled valve for supplying an internal combustion engine, according to the present invention, will be clear from the foregoing description. In particular, it enables changes to be made over time to the reference value for the signal suppled by potentiometer 111 and defining the minimum setting of throttle valve 112, thus enabling greater positioning tolerance of potentiometer 111 on spindle 129 of throttle valve 112, by virtue of the said minimum setting no longer being determined by a fixed output value on potentiometer 111. Furthermore, it provides for recovering system drift caused by changes in temperature, mechanical wear, etc., and, finally, for employing additional cold air devices acting directly on the setting of throttle valve 112.

To those skilled in the art it will be clear that changes may be made to the embodiment of the sytem described and illustrated herein without, however, departing from the scope of the present invention.

We claim:

1. A system for automatically defining the minimum setting of a valve (112) controlled by an accelerator (113) for supplying an internal combustion engine (101), comprising means (121) for repeatedly detecting the setting of said valve (112) in relation to a first given minimum setting value (FARMIN), said means (121) defining a new given minimum setting value (FARMIN) in the event that (1) the setting of said valve (112) remains steady for longer than a preset time limit, and (2) said new given minimum setting value is within predetermined setting limits respectively over and below the first given minimum setting value (FARMIN).

2. A system as claimed in claim 1, characterised by the fact that said means (121) comprise first means (13, 14) for detecting whether the setting (POSFARF) of said valve (112) is below said first given minimum setting value (FARMIN), or over said first given minimum setting value (FARMIN) and within a first preselected limit (ISTMIN), and which, in the event of a positive response, enable location of said new given minimum setting value.

3. A system as claimed in claim 2, characterised by the fact that said means (121) comprise second means (24, 16) for respectively determining a steady setting of said valve (112) below the said first given minimum setting value (FARMIN), or over said first given minimum setting value (FARMIN) and within said first preselected limit (ISTMIN).

4. A system as claimed in claim 3, characterised by the fact that said means (121) comprise third means (26) for determining maintenance of the setting of said valve (112) below said given minimum setting value (FARMIN) in excess of a first preset time limit, and control means (28) for reducing said given minimum setting value (FARMIN) by a preset value, within a lower limit (0) of said first given minimum setting value; said means (121) also comprising fourth means (19) for determining maintenance of the setting of said valve (112) over the said first given minimum setting value (FARMIN) and within said first preset limit value (ISTMIN) in excess of a second preset time limit, and designed to increase said given minimum setting value (FARMIN) by a preset value, within an upper limit (SSF) of said first given minimum setting value.

5. A system as claimed in claim 4, characterised by the fact that said first preset time limit is lower than said second preset time limit.

6. A system as claimed in claim 4, characterised by the fact that, at the first program performance of said means (121), said given minimum setting value (FARMIN) is established equal to said upper limit value (SSF) via fifth means (11, 12).

7. A system as claimed in claim 4, characterised by the fact that said preset time limits are detected by means of a counter (122).

8. A system as claimed in claim 1, and comprising a position transducer (111) connected mechanically to said valve (112) and designed to supply a signal (POSFARF) indicating said setting of said valve (112).

9. A system as claimed in claim 1, characterised by the fact that said means (121) comprise a microprocessor.

10. A system as claimed in claim 1, characterised by the fact that it is applied to an electronic injection system on said internal combustion engine.

* * * * *